US005379538A

United States Patent [19]

Osborne

[11] Patent Number: 5,379,538

[45] Date of Patent: Jan. 10, 1995

[54] DUAL-FUNCTION LABEL

[76] Inventor: Thomas E. Osborne, P.O. Box 209, Stewarts Point, Calif. 95480-0209

[21] Appl. No.: 541,950

[22] Filed: Jun. 22, 1990

Related U.S. Application Data

[63] Continuation of Ser. No. 235,173, Aug. 23, 1988, abandoned.

[51] Int. Cl.[6] ..... G09F 3/10

[52] U.S. Cl. ..... 40/299; 40/638; 156/66; 156/227

[58] Field of Search ..... 40/632, 299, 638, 662; 156/66, 216, 227

[56] References Cited

U.S. PATENT DOCUMENTS

| | | | |
|---|---|---|---|
| 2,636,297 | 4/1953 | Johnson | 40/638 |
| 3,130,509 | 4/1964 | Brooks | 40/662 |
| 3,703,044 | 11/1972 | Gregory . | |
| 3,933,560 | 1/1976 | Muttera | 156/227 |
| 3,993,814 | 11/1976 | Carender | 40/638 |
| 4,204,639 | 5/1980 | Barber et al. . | |
| 4,209,189 | 6/1980 | Betterly | 40/299 |
| 4,277,902 | 7/1981 | Miniaci et al. . | |
| 4,329,191 | 5/1982 | Barber . | |
| 4,513,522 | 4/1985 | Selenke | 40/638 |
| 4,577,426 | 3/1986 | Jenkins | 40/638 |
| 4,631,845 | 12/1986 | Samuel et al. | 40/638 |
| 4,865,352 | 9/1989 | Gollon | 433/299 |

FOREIGN PATENT DOCUMENTS

| | | | |
|---|---|---|---|
| 0222424 | 5/1987 | European Pat. Off. . | |
| 333874 | 3/1921 | Germany | 40/299 |
| 874985 | 3/1953 | Germany | 40/299 |
| 201300 | 11/1938 | Switzerland . | |
| 881699 | 11/1961 | United Kingdom . | |
| 942627 | 11/1963 | United Kingdom . | |
| 1158313 | 7/1969 | United Kingdom . | |
| 2047531 | 12/1980 | United Kingdom | 40/638 |
| 2047656 | 12/1980 | United Kingdom . | |
| 2100860 | 1/1983 | United Kingdom . | |
| 2158802 | 11/1985 | United Kingdom . | |

*Primary Examiner*—Cary E. O'Connor
*Attorney, Agent, or Firm*—Roland I. Griffin

[57] ABSTRACT

An adhesive backed label is perforated or scored along its mid-line. The same label either can be used as a standard adhesive label or it can be folded along its midline to capture the ends of a string and can be used as a tag label.

13 Claims, 3 Drawing Sheets

DUAL-FUNCTION LABEL

This application is a continuation of U.S. Ser. No. 07/235,173 filed Aug. 23, 1988, now abandoned.

BACKGROUND AND SUMMARY OF THE INVENTION

This invention relates generally to labels that are to be attached to objects and more specifically to those labels used by retail establishments emphasizing personal service and quality such as gift boutiques, jewelry stores, etc. Labels of this type are most frequently used to convey the price of an object to a consumer, but may also contain other information including inventory control numbers and/or the retailer's name. The labels may additionally relate information by their color (for example, a "red tag" sale).

Labels of this type fall into three distinct classes called "adhesion labels" 10, "tag labels" 12 and "dumbbell labels" 14, as shown in FIGS. 1, 2 and 3, respectively. Except for the information contained thereon, adhesion labels 10 and tag labels 12 have very little in common. The dumbbell label 14 is a hybrid of the other two.

Referring to FIG. 1, an adhesion label 10 consists of a medium 16 (usually, but not necessarily, paper) the back side of which contains an adhesive material and the front side of which is used to convey information to those who read the label. Although most adhesion labels use a self-adhesive material, other types of adhesive materials well known in the art may be used. Adhesion labels 10 are used by retailers to price and otherwise identify objects. They are applied adhesive side down to desired objects where they remain until removed. "Removable adhesion labels" use an adhesive material that allows them to be readily removed from objects upon which they are placed. "Permanent adhesion labels" use an adhesive material that must normally be dissolved with a solvent to remove them from an object.

Adhesion label manufacturers typically ship their labels 10 adhesive side down on a wax-like carrier 18 that allows self-adhesive labels to adhere to the carrier with enough tenacity that they remain in place on the carrier until they are to be used. At that time they are easily removed from the wax-like carrier 18 and applied to desired objects. The wax-like carrier 18 is typically a flat sheet without sprocket holes; however, it may be in the form of a strip with sprocket holes 19 along each side.

As shown in FIG. 4, large adhesion labels 20 having an asymmetrical perforated fold-line 22 are also known to exist. Adhesion labels 20 of this type are typically used to capture large flat items, such as plastic bags 24, as illustrated in FIG. 5. Smaller adhesion labels having a perforated tear-line permitting a portion of each such label to be removed from an object to which it is attached are also known to exist. Substantially all of the adhesive portions of both of these types of adhesion labels are dedicated to grasping the captured item itself.

Referring to FIG. 2, a conventional tag label 12 consists of a medium 26 in the form of a tag upon which information is conveyed on one or both sides and has a hole 28 (usually punched near one edge) through which a string 30 is threaded. To prevent the string 30 from falling out of the hole 28, it is usually knotted to form a continuous loop. Tag labels 12 are typically attached to objects having an appendage, such as the handle 32 of a teacup 34 as illustrated or the button of a garment. A tag label 12 is attached to such an object by placing an end portion of the continuous string 30 around the appendage, inserting the medium 26 through that end portion of the continuous loop, and pulling the tag medium to draw the continuous string loop taut and captivate the tag label on the appendage. Tag labels 12 are adhesive free and can typically be removed without destroying the label.

Referring to FIG. 3, a dumbbell label 14 is shaped like a dumbbell with two large symmetrical end portions 36 connected by a long thin intermediate portion 38. Like an adhesion label, a dumbbell label 14 has adhesive on its entire backside and is shipped by the manufacturer on a wax-like carrier. When a dumbbell label 14 is to be used, information is first written on one or both end portions 36. The dumbbell label 14 is then removed from the carrier and one end portion 36 is passed through an opening of an object to be labled, such as the opening defined by the handle of a teacup. Next, the end portions 36 of the dumbbell label 14 are aligned and joined together adhesive backside to adhesive backside. At the same time, corresponding parts of intermediate portion 38 are also aligned and joined joined together adhesive backside to adhesive backside. In effect, the intermediate portion 38 of a dumbbell label 14 emulates the string of a tag label and the end portions 36 of a dumbbell label emulate the medium of a tag label.

Dumbbell labels 14 and variants thereof have several drawbacks. First, unlike a tag label which may be attached to an object by passing only the string loop (not the medium) of the label through an opening of the object, a dumbbell label 14 must be attached to the object by passing one of the large end portions 36 (i.e., the medium) of the label through the opening. In some applications, such as where the opening is too small to pass the medium, this limitation is so severe that a dumbbell label 14 cannot be used at all. Even when the medium of a dumbbell label can be passed through the opening, it is difficult to keep the adhesive on the backside of the medium from inadvertantly touching the object being labeled. Attempts to disengage the medium from its unintended position almost always result in the dumbbell label being ruined. Even when the medium of a dumbbell label is properly passed through the opening, it is difficult to prevent the thin intermediate portion of the label from suffering the same fate. The intermediate portion's fragility virtually insures that the label will be ruined when attempting to disengage the intermediate portion from its improper position. Furthermore, even if the medium and intermediate portion of a dumbbell label are properly passed through the opening, it is very difficult to insure that the various parts of the dumbbell label will be properly aligned when their adhesive backsides first touch. There is no opportunity for a second try.

Even when the various parts of a dumbbell label are properly joined, other problems arise. The adhesive on the backside of the intermediate portion of a dumbbell label causes the intermediate portion to become attached to the object it loops. This results in the label permanently sticking out at what invaribly turns out to be an unnatural and unattractive angle. Another disadvantage of the dumbbell label is that the thin intermediate portion emulating the string loop of a tag label is substantially weaker than the string loop it emulates. In practice, dumbbell labels having adhesive backs are frequently torn off and lost. Finally, as is discussed in more detail later, adhesive-backed dumbbell labels have other drawbacks when they are automatically printed.

Occasionally a retailer will find that dishonest consumers "swap labels" (a process by which the dishonest consumer removes a label from a lower-priced object and substitutes that label for the label on a higher-priced object so that the higher-priced object can be purchased at a lower price). To counter this practice the retailer will use permanent adhesion labels. This increases the cost to the retailer because most permanent adhesion labels must be removed from an object by special solvents before the object is released to the consumer. There is also a high risk associated with using permanent adhesion labels because the solvents that dissolve the adhesive frequently dissolve the material on which the label is attached.

Tag labels are somewhat immune to label swapping because it takes a considerable amount of time to remove and replace a tag label, and speed is of the essence in label swapping. A special kind of dumbbell-like label made of a plastic material is used for those objects requiring a permanent label that is similar to a tag label. One end of such a label is passed through an opening of the object and thereupon permanently connected to the other end of the label by an irreversible interlocking mechanism. This kind of label can only be removed by destroying the label. Typically, this kind of label costs several times as much as the tag label it replaces.

It should be noted that a considerable amount of time is required to print information on labels and to attach the labels to an object. In practice it takes about the same amount of time to label an object as it does to process the sale of the object (i.e., labeling is not an insignificant operational cost). For objects like brass or glass that require periodic cleaning with solvents and/or polishing with agents that destroy labels, the labeling cost often exceeds the cost of processing the sale. Experience shows that labels must be removed from most objects that are given a thorough cleaning. Once a label is removed, it is almost always replaced by a new one because of the inordinate amount of time required to nondestructively remove tag labels and because nonpermanent adhesion labels lose much of their adhesive quality when they are removed from an object. Of course permanent adhesion labels, which are usually removed with special solvents, are always ruined when they are removed.

Most retailers still hand print their labels. The retailer usually selects an employee having good penmanship to initially print the labels and label the objects. Although errors are usually kept low at this stage, it is much more common for errors to be introduced when a previously labeled object is cleaned. The errors occur because the person cleaning the object is often not the same person who originally labeled the object, and the person who cleans an object usually is the one who relabels it. Any illegible labels or labels with transcription errors decrease the retailer's profits because an object having an illegible label or one bearing an erroneously higher price often remains unsold. An object with a label bearing an erroneously lower price will also reduce the retailer's profits because the retailer will almost always honor the lower price. The mislabeling problem is exacerbated since one usually cleans several objects at a time. Often the hands of the person cleaning the objects are dirty with polishing and/or cleaning agents from previous objects. These agents frequently adhere to the next label to be removed. After the object is cleaned it is common for the removed label to be almost unreadable, making it difficult to duplicate the original label. Furthermore, the person cleaning the objects is unlikely to ask for help in correcting any errors because the retailer has typically already told the person to be very careful when removing labels. Clearly, anything that can prevent errors or speed up the labeling process is desirable and will have a positive effect on the retailer's operations.

Although most retailers still hand print the information on their labels, the advent of low cost computers and reliable reasonably-priced printers allows retailers to machine print their labels rather than printing them by hand. This will eliminate some errors and reduce the frequency of the errors that find their way onto the labels of most manually-driven systems.

Automating the printing of labels creates a new set of problems. First, one must recognize the fact that the inexpensive and popular tag labels are not easily adapted to automatic printing. Unlike adhesion labels which readily adapt to sprocket-driven carriers, there is no readily available carrier to convey the tag labels past a print mechanism. Even if there were, it is clear that tag labels would have to be printed without the strings attached because the strings would undoubtedly raise havoc with contemporary low-cost print mechanisms. Thus, the retailer would have the added problem of threading a string through the hole in each printed tag label and knotting the ends of each such string to form a continuous string loop for each such label.

It is clear that neither the adhesion label nor the tag label is satisfactory for labeling all objects. For example, one would not label a wedding ring with an adhesion label or a crystal ball with a tag label. Thus, a fully automated printing system should be able to print information on both adhesion labels and tag labels. Since printers, though reasonably priced, are still one of the more expensive peripherals driven by a computer, it is economically desirable that the same printer be capable of printing on both adhesion and tag labels. However, if a printer existed that accommodated tag labels, it is unlikely that it would also accommodate adhesion labels. Thus, a retailer would need one printer dedicated to printing on adhesion labels and another printer dedicated to printing on tag labels. Most retailers would be forced to reject this two-printer solution because (1) two printers cost more than one printer; (2) a computer for controlling the printing process would require an operating system capable of selecting first one printer and then the other, and the operator would be required to select which of the two printers is to be used; (3) both printers would have to be located near each other since one has little choice in dictating the order in which objects are to be labeled; and (4) retailer's space concerns would lead them to reject the concept of keeping two printers one of which is always idle.

It is well known that when a carrier strip containing adhesion labels has been fed into a printer mechanism an attempt to "back up" the carrier strip will frequently, if not always, cause the adhesion labels to peel off the carrier strip and attach themselves deep within the printer mechanism, thereby rendering the printer mechanism inoperative. Accordingly, when it is time to remove the carrier strip from the printer mechanism, the carrier strip is typically severed as close as possible to the place at which it enters the printer mechanism. The portion of the carrier strip then remaining in the printer mechanism is thereupon fed forward through the printer mechanism to prevent adhesion labels from peeling off within the printer mechanism. Thus, each time the carrier strip is changed, a certain number of labels are sacrificed. It is therefore desirable that the carrier strip be changed infrequently, (i.e., not with every change in the kind or class of labels to be printed such as a change from adhesion labels to tag labels). Not only would this save labels, but it would also save the time spent loading and aligning the carrier strip.

The present state of the art for solving the dual requirements of both the adhesion label and the tag label is to use the dumbbell label in place of the tag label. Although it already has been shown that the dumbbell label is inferior to the tag label, other undesirable attributes arise when one prints upon a dumbbell label with a state-of-the-art printer. It should be noted that given the opportunity, consumers almost always orient an object's label so that the label's printing is read in the customary left to right order. This means that a consumer often rotates and adjusts a conventional tag label from its hanging position into a position from which it is more easily read. This will also be done with a dumbbell label when its printing is improperly oriented. The inherent fragility of the dumbbell label dictates that its printing be oriented such that the label can be read without twisting or turning it. To accomplish this, when a dumbbell label is vertically oriented on a carrier, it is highly desirable, and probably necessary, for the printer to be able to print information on one of the end portions of the dumbbell label in an inverted format. This will result in the printing being properly oriented when the two end portions of the dumbbell label are folded over and joined. It should also be noted that it is undesirable and perhaps unacceptable to print information on a dumbbell label so that the information is oriented parallel to the intermediate portion joining the two end portions. To do so would suggest orienting the dumbbell label parallel to the horizon to make its printing read properly left to right. Most retailers would reject this orientation on the grounds of bad taste and poor design asthetics.

Even if one accepts the dumbbell label, the best one-printer solution using state of the art printers and both adhesion and dumbbell labels would be to have either one carrier strip containing only adhesion labels and another carrier strip containing only dumbbell labels, or to have a single carrier strip containing both kinds of labels (they could be disposed side by side or could alternate vertically). The first solution is very impractical because it would be necessary to change carrier strips each time one changes the kind of label to be printed. As has been mentioned, changing carrier strips wastes labels and takes time. The second solution is also impractical because there is a high probability that at any time only one of the two kinds of labels under the print head would be used. Both solutions suffer from the fact that the physical characteristics of the two kinds of labels differ considerably from each other. This implies that the printing system must support two different print routines and the operator must specify which kind of label is to be printed. In addition to the foregoing complications, and as noted above, the dumbbell label is at best an inferior approximation to the popular tag label. Thus, it is seen that there exists the need for a single labeling system that adequately solves the dual requirements of printing on adhesion labels and tag labels.

Accordingly, an object of an aspect of the present invention is to create a dual-function label that can be used either as an adhesion label or as a tag label.

Another object of an aspect of the present invention is to create such a dual-function label for which there is no difference in the printing requirements of the label whether it is to be used as an adhesion label or as a tag label.

Another object of an aspect of the present invention is to create a dual-function label that gives the user the option of deciding whether the label is to be used as an adhesion label or as a tag label after the label has been printed.

Another object of an aspect of the present invention is to create an inexpensive tag label that gives retailers a clear indication that the label has been tampered with if it is removed from an object.

Another object of an aspect of the present invention is to create a tag label for which the length of the string loop can be selected at the time the label is affixed to an object.

Another object of an aspect of the present invention is to create a labeling system that eliminates the need to change carrier strips when changing from printing adhesion labels to printing tag labels or visa versa.

Still another object of an aspect of the present invention is to eliminate wasted labels when they are machine printed.

DESCRIPTION OF THE PREFERRED EMBODIMENTS

Figure 1:
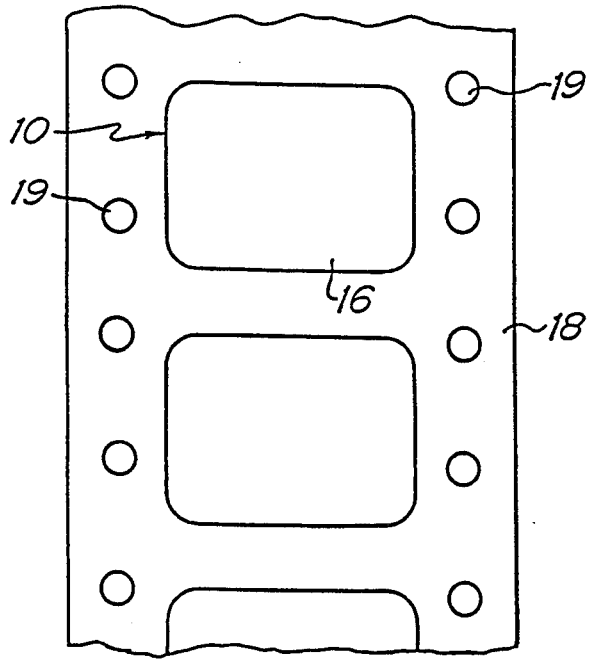
Figure 1 (PRIOR ART)
FIG. 1 shows prior art adhesion labels disposed on a carrier strip.
Figure 2:
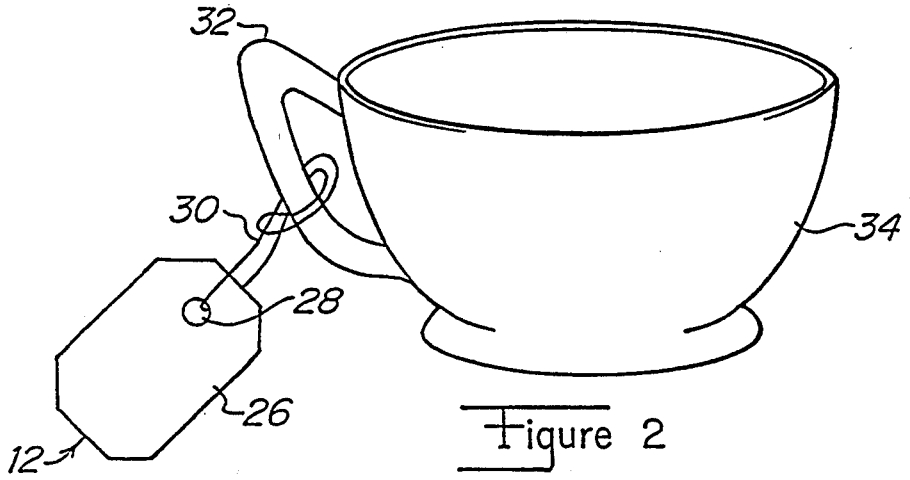
Figure 2 (PRIOR ART)
FIG. 2 shows a prior art tag label attached to a teacup.
Figure 3:
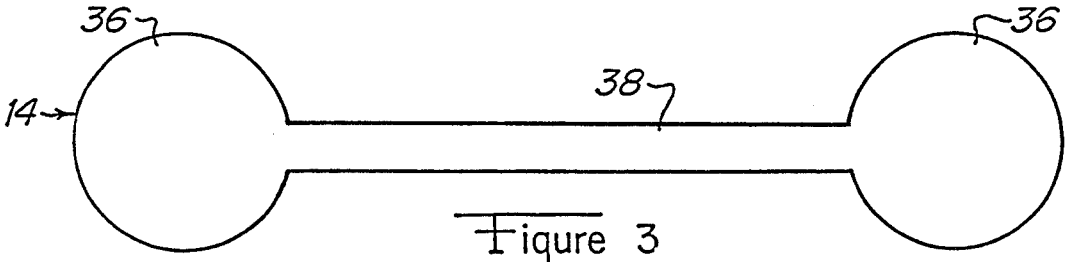
Figure 3 (PRIOR ART)
FIG. 3 shows a prior art dumbbell label.
Figure 4:
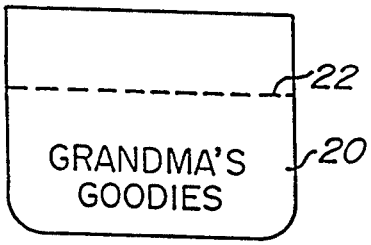
Figure 4 (PRIOR ART)
FIG. 4 shows a prior art adhesion label having a fold line.
Figure 5:
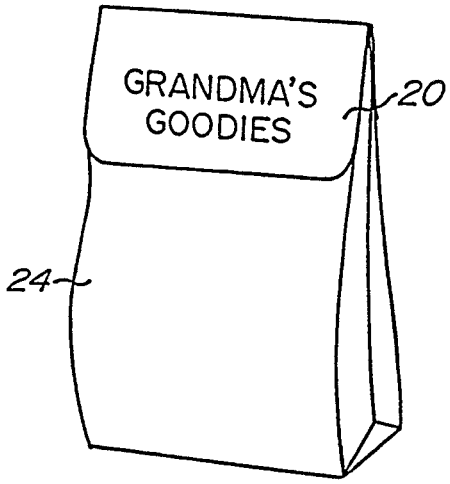
Figure 5 (PRIOR ART)
FIG. 5 shows how the prior art adhesion label of FIG. 4 is attached to an item so that the item is sandwiched by the folded adhesive backside of the label.
Figure 6:
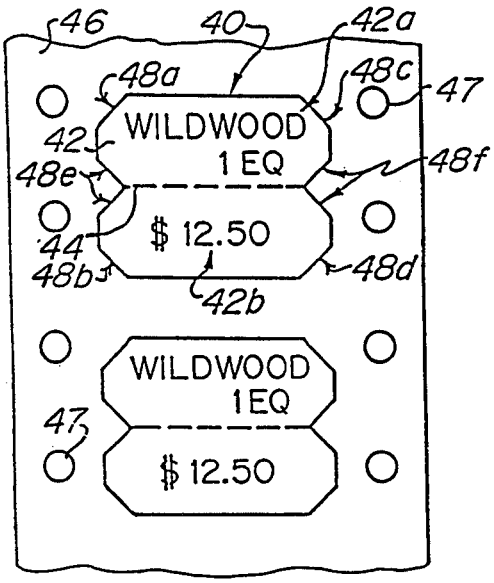
FIG. 6 shows dual-function labels according to a preferred embodiment of the present invention with the labels located on a carrier strip and printed.

Referring now to FIG. 6, there is shown a plurality of dual-function labels 40, which according to the preferred embodiment of the present invention may be used either as adhesion labels or as tag labels. Each of these dual-function labels 40 comprises a medium 42 symmetrically divided into two halves 42*a* and 42*b* by a scored or perforated fold line 44 with each half being the mirror image of the other. The medium 42 may be made of any of the various materials, such as paper, commonly used to make conventional adhesion labels.

Both halves 42*a* and 42*b* of the medium 42 are adapted to receive printed information, such as that indicated, on the front side and are provided with a coating of adhesive material on the backside.

The dual-function labels 40 are affixed to a wax-like carrier strip 46, such as that used in connection with conventional adhesion labels, and are horizontally oriented in vertical alignment to facilitate machine printing on the front side of one or both halves of each label. Sprocket holes 47 are provided along each side of the carrier strip 46 to facilitate its being driven through printers with conventional sprocket-drive mechanisms. Although the design of a dual-function label intended for use in such a printer would very likely locate the fold line 44 half way between printed lines, this is not a requirement (print that falls on the fold line is quite legible). It should be noted that even though the dual-function labels 40 are designed so that information may be easily printed thereon by conventional printers, the labels serve equally well whether the information is machine printed or manually printed.

Each dual-function label 40 has chamfered corners 48*a–d*. Though not a strict functional necessity, such chamfered corners are highly desirable. For adhesion label applications, sharp corners are to be avoided because they are easily snagged and tend to fold over. Once this happens, the label looks bad and is even more vulnerable to snagging. It is common knowledge that a partially detached label is well on its way to becoming totally detached. Each dual-function label 40 also has cutouts 48*e* and 48*f* at each end of the fold line 44. These fold-line cutouts are the mirror image of the corresponding chamfered corners. Although the fold-line cutouts 48*e* and 48*f* are not a strict functional requirement, they are also desirable because for tag label applications chamfered or rounded corners are more asethetically appealing and sharp corners are easily bent, blunted or otherwise damaged. It is well known that objects with damaged labels undersell objects with undamaged labels.

Figure 7:
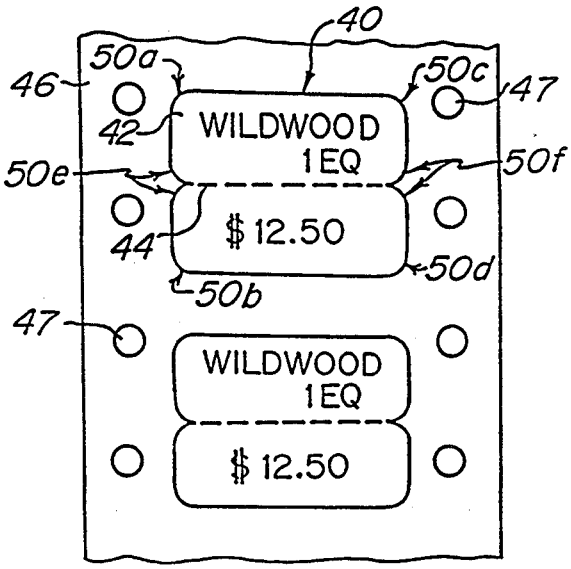
FIG. 7 shows dual-function labels according to another preferred embodiment of the present invention with the labels located on a carrier strip and printed.

In accordance with another embodiment of the present invention, the chamfered corners 48*a–d* and the corresponding fold-line cutouts 48*e–f* of each dual-function label 40 may be replaced by rounded corners 50*a–d* and corresponding fold-line cutouts 50*e–f* as shown in FIG. 7. It should also be noted that the shape of the corners 48*a–d* or 50*a–d* could be different from the shape of the fold-line cutouts 48*e–f* or 50*e–f*, although most applications favor symmetric corners and fold-line cutouts. In addition, it should be noted that some applications may dictate that the shape of the corners 48*a–b* or 50*a–b* differs from the shape of the corners 48*c–d* or 50*c–d* and/or that the shape of the fold-line cutouts 48*e* or 50*e* differs from the shape of the fold-line cutouts 48*f* or 50*f*.

Figure 8:
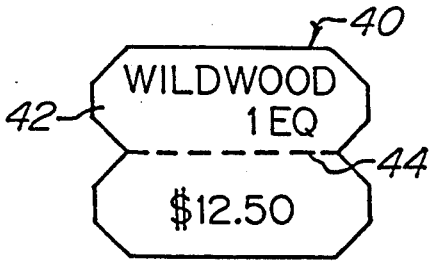
FIG. 8 shows the front side of one of the dual-function labels of FIG. 6 after it has been removed from the carrier strip to be used as an adhesion label.
Figure 9:
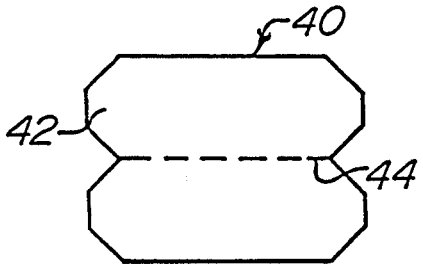
FIG. 9 shows the adhesive backside of the dual-function label of FIG. 8.

A printed dual-function label 40 may be used as an adhesion label by simply removing the label from the carrier strip 46 and applying the label adhesive backside down to the object to be labeled. The front side and the backside of the printed dual-function label 40 appear as shown in FIGS. 8 and 9 when the dual-function label is removed from the carrier strip 46. Even though the medium 42 of the dual-function label 40 remains unfolded when the dual-function label is used as an adhesion label, the fold line 44 is almost invisible.

Figure 10A:
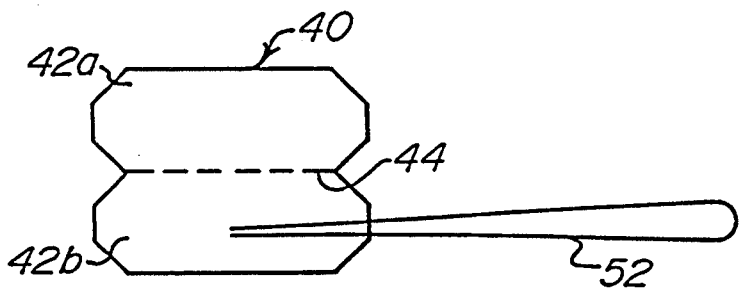
FIGS. 10*a–c* show how the dual-function label of FIGS. 8 and 9 is converted into a tag label by folding the label at its symmetrical fold line to sandwich a string between the adhesive backsides of its matching halves.
Figure 10B:
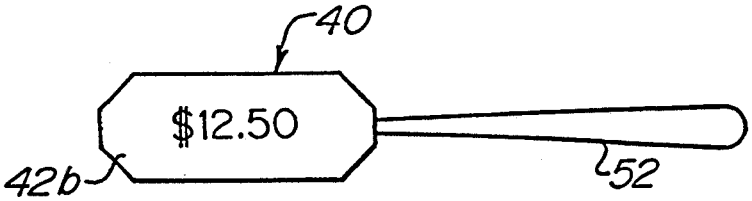
Figure 10C:
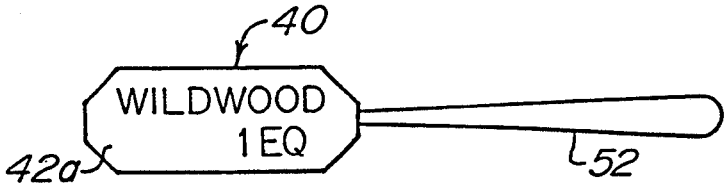

The dual-function label 40 has the characteristic that it may alternately be used as a tag label. This is accomplished by attaching a string loop 52 to the adhesive backside of one of its two halves 42*a* or 42*b*, as shown in FIG. 10*a*, and by folding the dual-function label along its fold-line 44 so that the adhesive backsides of its two halves are aligned and joined together to capture the string loop as shown in FIGS. 10*b* and 10*c*. Clearly, tag labels formed by using the dual-function label 40 have all of the advantages and attributes of a conventinal tag label. However, in addition, tag labels formed by using the dual-function label 40 have several distinct advantages not provided by conventional tag labels.

Unlike a conventional tag label that must have a hole through which a string may be threaded and knotted to form a string loop, the dual-function label 40 may be used as a tag label without forming such a hole, or threading and knotting a string, by simply sandwiching the string loop 52 between the backsides of the two halves of the dual-function label. Eliminating the hole through which the string is threaded increases the area available on the dual-function label 40 for printing or, conversely, permits a smaller dual-function label 40 to hold the same amount of printing as a larger conventional tag label with a hole. It should be noted, however, that if desired the dual-function label 40 can be designed to contain a hole at the same position in each of its halves to make the shape and function of the dual-function label exactly like the shape and function of the conventional tag label.

Tag labels formed by using the dual-function label 40 are also much easier to affix to an object because the string loop 52 can be passed through an opening of the object before being sandwiched between the adhesive backsides of the two halves of the dual-function label. Moreover, a tag label formed by using the dual-function label 40 and attached to an object by the method just described becomes a permanent label because it cannot be removed without leaving evidence that the label has been tampered with. Even if the backside of the dual-function label 40 is coated with a removable adhesive material, such materials are extremely cohesive when the backsides of the two halves of the dual-function label are joined together. Finally, it should be noted that unlike a conventional adhesion label, the adhesive backside of which is directly affixed to the object to be labeled, when a dual-function label 40 is used as a tag label the adhesive backsides of the two halves of the dual-function label contact each other rather than the object.

I claim:

1. A method of labeling objects with a dual-function label, said method comprising the steps of providing a medium having a front side for receiving information, a back side completely coated with adhesive material, and a fold line physically formed in and completely bisecting the medium into two halves with each half being a mirror image of the other; selectively providing a separate fastening element; determining whether the dual function label is to be used as an adhesion label or as a tag label; and selectively either affixing the adhesive back side of the medium to an object in an unfolded state when the label is to be used as an adhesion label, or folding the medium along the full length of the fold line into two matching halves having their adhesive back sides joined together to capture said fastening element therebetween so that the folded medium may be attached to an object by the fastening element when the label is to be used as a tag label.

2. The method of claim 1, wherein said medium is predominantly rectangular in shape so that said dual-function label, when used as an adhesion label in the unfolded state, is predominantly rectangular in plan view.

3. The method of claim 1, wherein said medium has chamfered corners which are juxtaposed an each other when the medium is folded into two matching halves.

4. The method of claim 1, wherein said medium has rounded corners which are juxtaposed on each other when the medium is folded into two matching halves.

5. The method of claim 1, wherein said medium has a cutout at each end of the fold line, and each cutout is symmetric about the fold line so that opposed portions of the cutouts are juxtaposed upon folding of the medium into two matching halves for use as a tag label.

6. The method of claim 5, wherein said cutouts conform to corresponding corners in size and shape.

7. The method of claim 1, wherein said medium has a cutout at each end of the fold line and has chamfered corners; said cutouts and chamfered corners being symmetric about the fold line and being formed so that said cutouts conform to corresponding chamfered corners in size and shape when the medium is folded.

8. The method of claim 7, wherein said cutouts and chamfered corners match such that when the medium is folded at the fold line and the adhesive back sides of each half are joined together newly formed chamfered corners located at each end of the fold line are of the same size and shape as the corresponding chamfered corners opposite from the fold line.

9. The method of claim 1, wherein said medium has a cutout at each end of the fold line and has rounded corners; said cutouts and rounded corners being symmetric about the fold line and being formed so that said cutouts conform to corresponding rounded corners in size and shape when the medium is folded.

10. The method of claim 9, wherein said cutouts and rounded corners match such that when the medium is folded at the fold line and the adhesive back sides of each half are joined together newly formed rounded corners located at each end of the fold line are of the same size and shape as the corresponding rounded corners opposite from the fold line.

11. The method of claim 1, wherein said fastening element is a string and said medium is folded at the fold line to capture a loop of the string by which the label can be attached to an object.

12. The method of claim 11, wherein said medium is made of a flexible material and has a maximum width less than its length.

13. The method of claim 1, wherein said medium is removably disposed on a carrier with the adhesive back side of said medium in contact with the carrier and with the front side of said medium facing away from the carrier; and comprising the further step of removing the medium from the carrier before use as a label.

* * * * *